US010156076B1

(12) United States Patent
Van Tiggelen

(10) Patent No.: US 10,156,076 B1
(45) Date of Patent: Dec. 18, 2018

(54) POST SUPPORT, RETAINING WALL AND METHOD

(71) Applicant: Douglas L Van Tiggelen, Bernville, PA (US)

(72) Inventor: Douglas L Van Tiggelen, Bernville, PA (US)

( * ) Notice: Subject to any disclaimer, the term of this patent is extended or adjusted under 35 U.S.C. 154(b) by 54 days.

(21) Appl. No.: 15/288,711

(22) Filed: Oct. 7, 2016

(51) Int. Cl.

| | |
|---|---|
| ***E04F 11/18*** | (2006.01) |
| ***E02D 29/02*** | (2006.01) |
| ***E04H 17/22*** | (2006.01) |
| ***E04H 12/22*** | (2006.01) |
| ***E02D 27/42*** | (2006.01) |

(52) U.S. Cl.
CPC ..... *E04F 11/1804* (2013.01); *E02D 27/42* (2013.01); *E02D 29/025* (2013.01); *E02D 29/0225* (2013.01); *E04H 12/2261* (2013.01); *E04H 17/22* (2013.01)

(58) Field of Classification Search
CPC ..... E04F 11/18; E04F 11/1804; E02D 27/42; E02D 29/0225; E02D 29/025; E04H 12/2261; E04H 17/22
See application file for complete search history.

(56) References Cited

U.S. PATENT DOCUMENTS

| | | | | |
|---|---|---|---|---|
| 5,431,372 | A * | 7/1995 | Kostelecky | E01F 13/022 182/45 |
| 7,823,348 | B1 * | 11/2010 | Leiva | E04G 21/185 52/170 |
| 2004/0020713 | A1 * | 2/2004 | Fregosi | E04G 3/20 182/82 |
| 2006/0213722 | A1 * | 9/2006 | Cunningham | E04G 1/38 182/82 |
| 2009/0159864 | A1 * | 6/2009 | Perris | E04G 21/3223 256/59 |
| 2010/0171085 | A1 * | 7/2010 | Webster, IV | E01F 15/0461 256/65.14 |
| 2014/0105686 | A1 * | 4/2014 | Southworth | E02L 37/02 405/107 |

FOREIGN PATENT DOCUMENTS

| | | | | |
|---|---|---|---|---|
| CA | 2127927 C | * | 12/1997 | E04H 12/2261 |

* cited by examiner

*Primary Examiner* — Tara Mayo-Pinnock
(74) *Attorney, Agent, or Firm* — Robert J. Yarbrough; Lipton, Weinberger & Husick

(57) ABSTRACT

A post support includes a platform portion and an attached post portion. The end of the post portion distal to the platform portion is in a laterally and vertically spaced-apart relation to the platform portion. When the platform portion is buried adjacent to a stack wall with the post portion between the platform portion and the stack wall and with a fence or handrail post attached to the end of the post portion, a lateral load applied to the fence or handrail post is supported by the platform portion without damage to the stack wall.

13 Claims, 8 Drawing Sheets

POST SUPPORT, RETAINING WALL AND METHOD

I. BACKGROUND OF THE INVENTION

A. Field of the Invention

The Invention is a post support for a fence or handrail post. The invention is also a retaining wall including the post support and is also a method of building a retaining wall using the post support.

B. Statement of the Related Art

As used in this document, a 'retaining wall' is a barrier used to achieve an abrupt change of grade of land between a higher elevation and a lower elevation. The retaining wall supports earth at a higher elevation on one side of the retaining wall and prevents the movement of the earth to the side having a lower elevation. As used in this document, the term 'earth' means soil of any type, including loam, sand, clay and fill material. The term 'fill material' includes crushed stone of any size, gravel, quarry dust, sand, rock, or masonry and includes any material imported to a location that changes the grade of the location. A properly designed and constructed retaining wall is an engineered structure that will resist the pressure of earth and fill on the higher elevation side of the retaining wall, even when the earth and fill is saturated with water.

The strength of a retaining wall may be selected for a particular application; for example, the retaining wall may be a very strong poured concrete wall used as a basement wall. Conversely, the retaining wall may be laterally weak, as in a stack wall using in landscaping. 'Stack wall' means a type of retaining wall composed of stones or concrete blocks that are stacked one on top of another and that are held in place by the force of gravity and without mortar. Only the weight of the stones or blocks and the mechanical interference between adjacent stones or blocks keep the stack wall in place and holds back the earth and fill material.

The abrupt elevation change across the retaining wall may present a hazard to persons, pets or other animals; namely, a person, pet or other animal may fall from the higher elevation side of the retaining wall. To avoid the potential hazard, a fence or handrail supported by posts may be installed on the higher elevation side of the retaining wall.

Where the lateral strength of the retaining wall is adequate, the posts supporting the fence or handrail may be attached directly to the retaining wall and any lateral load applied to the fence or handrail is supported by the strong retaining wall. A 'lateral load' is a force, for example a force applied by a person or animal, against the fence or handrail and from the direction of the higher elevation side of the retaining wall toward the lower elevation side of the retaining wall and generally normal to a plane defined by the surface of the retaining wall. Attaching the posts to the retaining wall has the advantage of providing the maximum usable ground area above the retaining wall. Where the retaining wall is not laterally strong, such as a stack wall, attaching the posts directly to the top of the retaining wall may cause the retaining wall to collapse when a lateral load is applied to the fence or handrail.

As an alternative to attaching the fence or handrail posts to the retaining wall, the bottom end of the posts may be buried in the earth or fill on the higher elevation side of the retaining wall. Where the retaining wall is laterally strong, the posts may be buried near the retaining wall, preserving the use of the ground on the higher-elevation side of the retaining wall.

Where the retaining wall is a stack wall or is otherwise not laterally strong, burying the posts close to the retaining wall may allow a lateral load applied to the fence or handrail to be transferred to the retaining wall, which may cause the retaining wall to collapse. To avoid collapse of the laterally weak retaining wall, the posts must be buried well back from the retaining wall so that a lateral load applied to the fence or handrail is supported by the surrounding earth or fill and is not transferred to the retaining wall. Setting the posts back from the retaining wall results in loss of use of ground on the higher elevation side of the retaining wall, which is not desirable.

The prior art does not teach a post support that allows the fence or handrail to be constructed immediately adjacent to a laterally weak retaining wall, such as a stack wall, and thus preserving the use of the ground above the laterally weak retaining wall.

II. BRIEF DESCRIPTION OF THE INVENTION

The post support of the invention allows a post for a fence or handrail to be installed immediately adjacent to the higher-elevation side of a to a laterally weak retaining wall, such as a stack wall. A lateral load applied to the fence or handrail will not apply a lateral load to the retaining wall and will not cause the wall, fence or handrail to fail.

A platform portion and a post portion define the post support. The platform portion is configured to be buried under earth or fill on the higher-elevation side of the retaining wall so that the platform portion is generally normal to the retaining wall. The post portion extends in an upward direction from the platform portion so that when the platform portion is buried, the post portion extends to grade level or slightly above grade level. The post portion terminates in a bottom flange. When the post support is installed, the bottom flange is attached to a mating top flange that is attached to a fence or handrail post. The fence or handrail post supports the fence or handrail.

When a lateral load is applied to the fence or handrail attached to the buried post support, the fence or handrail post and the post portion act as a moment arm that tends to rotate the platform portion about a fulcrum in response to the lateral load. The fulcrum generally will be defined by the edge of the platform portion closest to the retaining wall. The weight of the earth and fill above the buried platform portion resists that rotation of the platform about the fulcrum and acts generally upon a second moment arm extending from the center of the platform portion to the fulcrum. If the weight of the earth and fill above the platform is adequate, the platform will not move and the fence or handrail will resist the lateral load without movement.

The earth and fill immediately above the platform portion is not the only earth and fill resisting the lateral load applied to the fence or handrail. Force applied by the platform portion to the earth and fill directly over the platform portion will cause the earth and fill to apply a force to the earth and fill located between the platform portion and the retaining wall. The weight and friction of the fill and earth between the platform portion and the retaining wall contributes to the resistance of the platform to a lateral load applied to the fence or handrail. In addition, friction between adjacent grains of the earth or fill will resist motion of the platform portion, as will turf roots or roots of other plants growing in the earth or fill over the platform portion.

The platform portion may have a configuration to prevent earth or fill from moving through the platform portion. For example, the platform portion may have a solid surface or a grid surface where the openings in the grid are too small to allow the passage of earth or fill.

Alternatively, the platform portion may define openings large enough to allow soil and fill to pass through the openings. In the event the platform portion defines openings large enough to allow soil or fill to pass through, a geotextile fabric may be disposed above and below the platform portion when the platform portion is installed. The geotextile fabric is selected to have openings that are adequately small to prevent motion of the earth or fill through the platform portion.

The post portion terminates at its upper end in a bottom flange. The bottom flange is configured for connection to a mating top flange that is attached to the fence or handrail post. The bottom flange is in a spaced-apart relation, both vertically and horizontally, from the platform portion. The vertical separation between the bottom flange and the platform portion allows the platform portion to be buried adequately deeply so that the weight of the fill and earth on the top of the platform portion will adequately resist deflection of the post portion when the post portion is attached to a fence or handrail post.

The vertical separation distance may be selected to allow the platform portion to be buried below the frost line. The frost line is the location in the ground below which water does not freeze during cold weather. The depth of the frost line varies by location, depending on the local climatic conditions. A buried object that is above the frost line is subject to 'frost heave,' which is displacement of the object by the expansion of water as the water freezes. A platform portion that is buried below the frost line is not subject to frost heave and will not be disturbed by freezing and thawing conditions. The vertical separation distance may be selected based on the depth of the frost line for the particular location in which the fence or handrail post will be installed.

The horizontal separation distance between the platform portion and the bottom flange is selected so that when installed the platform portion is set back by a sufficient distance from the retaining wall that the earth and fill located between the platform portion and the retaining wall adequately resists lateral movement in response to a lateral force applied by the earth and fill located above the platform portion and so that the earth and fill located between the platform portion and the retaining wall will not transmit force to the retaining wall.

The lower part of the post portion may define a curve or other shape to reduce the length of the post portion that is immediately adjacent to the retaining wall. By using a curve or other shape, in the event of overloading the post portion in the lateral direction so that the post portion presses against the retaining wall, only the topmost portion of the retaining wall engages the post portion and only the topmost portion of the retaining wall is damaged. Providing that the lower part of the post portion defines a curve or other shape to reduce the length of the post portion adjacent to the retaining wall eases the task of repair of the retaining wall in the event of failure of the post support due to overloading.

As a second embodiment, the post portion may extend vertically from the platform portion so that the bottom flange is not displaced laterally from the platform portion. In this second embodiment, only the weight of the fill and earth immediately above the platform portion resists a lateral load applied to the fence or handrail post. For this embodiment, the platform portion may be larger than in the first embodiment so that a greater weight of fill and earth is above the platform portion. Alternatively, the platform portion may be buried deeper in the fill and earth, also so that a greater weight of fill and earth is above the platform portion.

As noted above, the platform portion tends to rotate about a fulcrum when a lateral load is applied to the fence or handrail. As a third embodiment, the fulcrum may be defined by a separate fulcrum member that is in a spaced-apart relation to the platform portion and that is disposed between the platform portion and the retaining wall when the post support is installed. The separate fulcrum member provides a longer moment arm between the fulcrum and the platform portion, allowing a smaller platform portion to resist the same lateral load or allowing the same platform portion to resist the same lateral load while buried under less earth and fill than the first or second embodiments.

Because the platform portion is buried by fill and earth and generally will be installed on a base of crushed stone, the bottom flange may not be level when installed. A mechanism is provided to allow the fence or handrail posts to be plumb, even when the bottom flange is not level. Any suitable mechanism may be used. One possible leveling mechanism comprises a top flange that is attached to the fence or handrail post and that is configured for engagement with the bottom flange. Jackscrews may engage both the top and bottom flange. The jackscrews may define a first end having a right-hand thread and a second end having a left-hand thread. Each jackscrew between the first and second ends defines a tool connection, such as a hex-shape to receive an open-ended wrench. Each of the top and bottom flanges is threaded to receive one end of each jackscrew. Turning a jackscrew in one direction while the jackscrew is in threaded engagement with the top and bottom flanges will increase the distance between the flanges. Turning the jackscrew in the other direction will decrease the distance between the flanges. Four jackscrews have proven suitable in practice, but three or more jackscrews also are suitable. Locking screws may fix the two flanges in position once the jackscrews are adjusted.

For applications where adjusting the height of the fence or handrail post is not critical, the adjustment mechanism may comprise two jackscrews combined with a single pivot of a pre-selected height. Other alternatives include shims between the top and bottom flanges and a ball-and-socket joint between the top and bottom flanges. Any mechanism known in the art for adjusting and angle or height between two objects is contemplated by the invention.

III. BRIEF DESCRIPTION OF THE DRAWINGS

IV. DESCRIPTION OF AN EMBODIMENT

The post support 2 of the invention allows a fence or handrail 4 to be installed immediately adjacent to a stack wall 6 while preventing a lateral load 8 applied to the fence or handrail 4 from damaging the stack wall 6 or resulting in failure of the fence or handrail 4.

Figure 1:
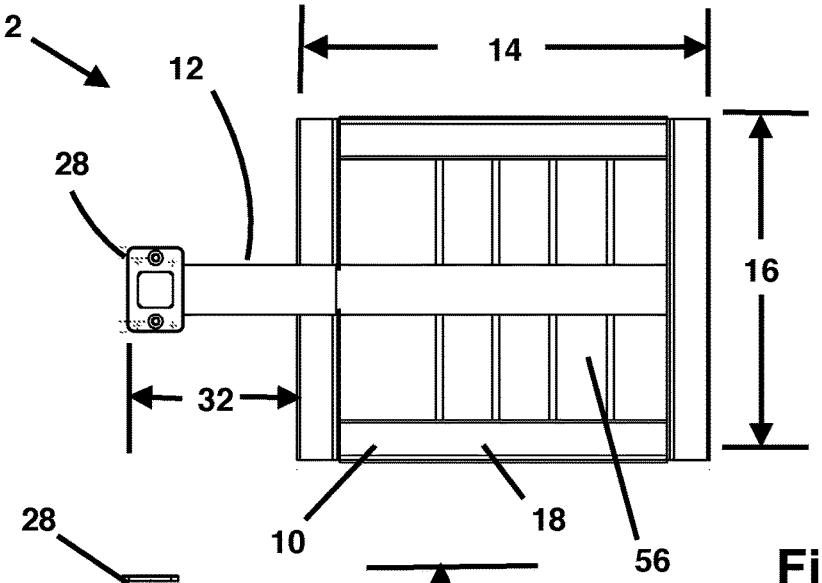
FIG. 1 is a plan view of the post support.
Figure 2:
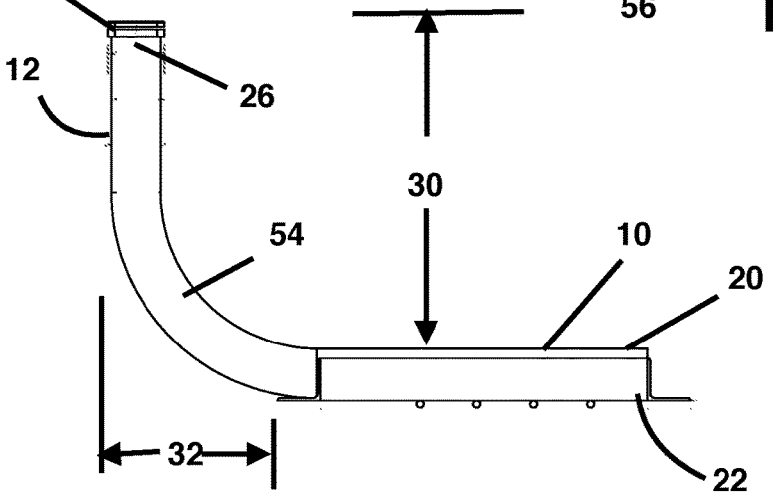
FIG. 2 is a side view of the post support.

FIGS. 1 and 2 are a top view and side view, respectively, of one embodiment of the post support 2. The post support 2 has a platform portion 10 and post portion 12. The platform portion 10 has a length 14 and a width 16, which together define a platform area 18. The platform portion 10 also defines a top side 20 and a bottom side 22. From FIGS. 1 and 2, the post portion 12 is attached to the platform portion 10. An end 26 of the post portion 12 distal to the platform portion 10 terminates in a bottom flange 28. The bottom flange 28 is in a laterally spaced-apart relation 30 and a vertically spaced-apart relation 32 to the platform portion 10.

Figure 3:
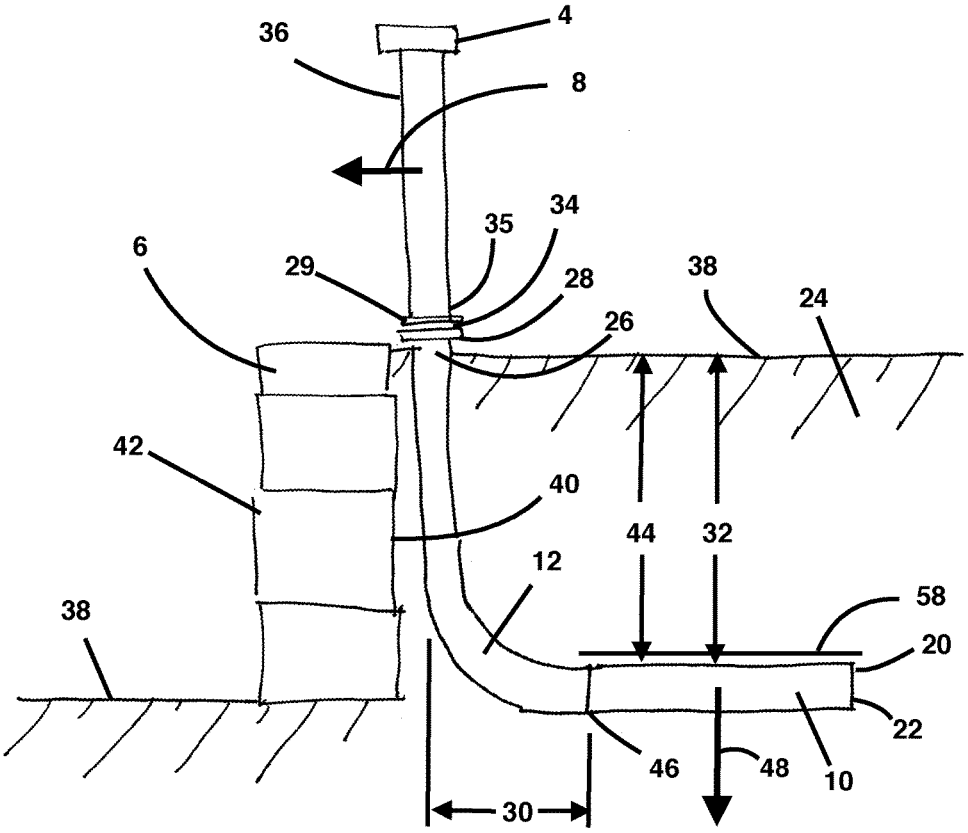
FIG. 3 is a side view of the installed post support.
Figure 4:
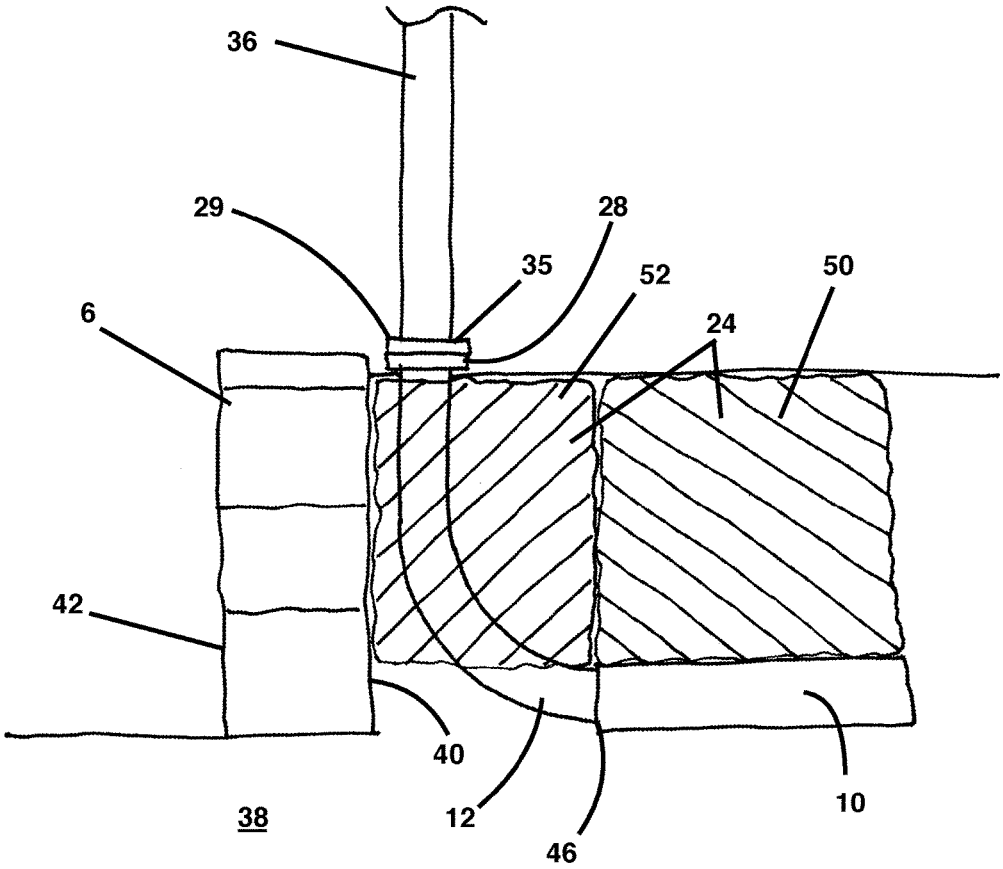
FIG. 4 is a side view of the installed post support.

FIGS. 3 and 4 are side views of the post support 2 installed adjacent to a stack wall 6. The stack wall 6 separates ground 38 on a higher elevation side 40 from ground 38 on a lower elevation side 42. The platform portion 10 is buried on the higher elevation side 40 under a predetermined depth 44 of earth or fill 24 with the platform area 18 oriented generally normal to the direction of the pull of gravity 48. The post portion 12 is located between the platform portion 10 and the stack wall 6 and the bottom flange 28 is located immediately adjacent to the stack wall 6. As a result, the lateral spaced-apart relation 30 defines the distance between the platform portion 10 and the stack wall 6. The bottom flange 28 defines an attachment location 34 to attach the post portion 12, and hence the platform portion 10, to the post base 35 of the fence or handrail post 36. The post base 35 defines a top flange 29 that is selectably attached to the bottom flange 28.

As shown by FIGS. 3 and 4, the bottom flange 28 and the post base 35 are located proximal to the surface of the ground 38 when the platform portion 10 is buried under the predetermined depth 44 of earth or fill 24. As a result, the vertically spaced-apart relation 32 of the bottom flange 28 and the platform portion 10 determines the predetermined depth 44 of earth or fill 24 over the platform portion 10.

From FIG. 4, a lateral load 8 applied to the fence or handrail 4, and hence to the fence or handrail post 36, applies a load to the post portion 12 and to the platform portion 10. The lateral load 8 tends to cause the platform portion 10 to rotate about a fulcrum 46 generally defined by the side of the platform portion 10 proximal to the stack wall 6. The weight of the volume 50 of earth or fill 24 above the platform portion 10 resists the rotation of the platform portion 10 and hence resists the motion of the post portion 12 and the fence or handrail post 36.

Also as shown by FIG. 4, the lateral load 8 applied to the earth or fill 24 above the platform portion 10 also will tend to compress the volume 52 of earth or fill 24 located between the platform portion 10 and the stack wall 6. The volume 52 of earth or fill 24 located between the platform portion 10 and the stack wall 6 therefore also resists the rotation of the platform portion 10 about the fulcrum 46.

Figure 6:
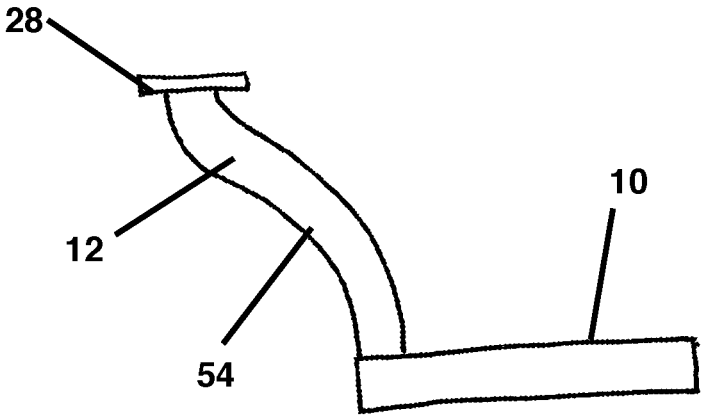
FIG. 6 is a side view of a third embodiment of the post support.

From FIGS. 3, 4, and 6, the post portion 12 proximal to the platform portion 10 may define a curve 54 or other shape so that only the part of the post portion 12 proximal to the bottom flange 28 is adjacent to the stack wall 6. The remainder of the post portion 12 is farther away from the stack wall 6 than the part proximal to the bottom flange 28. If the post support 2 is overloaded by a lateral load 8 applied to the fence or handrail post 36 so that the platform portion 10 rotates about the fulcrum 46 and so that the post portion 12 contacts the stack wall 6, only the part of the stack wall 6 adjacent to the bottom flange 28 contacts the stack wall 6 and only the top courses of the stack wall 6 are damaged by the movement of the post portion 12.

Figure 5:
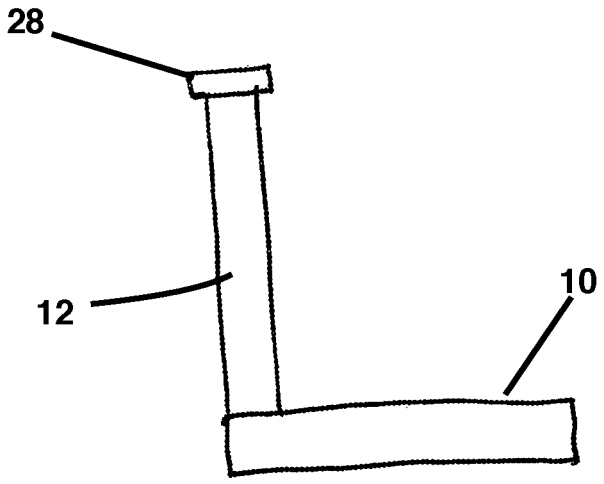
FIG. 5 is a side view of a second embodiment of the post support.

FIG. 5 illustrates an alternative embodiment in which the post portion 12 extends vertically from the platform portion 10. When the configuration of FIG. 5 is installed adjacent to a stack wall 6, the post portion 12 will be adjacent to the stack wall 6 for the length of the post portion 12. For the embodiment of FIG. 5, if the lateral load 8 applied to the fence or handrail post 36 overloads the platform portion 10 and causes the platform portion 10 to rotate about the fulcrum 46, more of the stack wall 6 will be damaged than for the configurations addressed by FIGS. 1-4 and FIG. 6. In addition, the volume 52 of earth or fill 24 between the platform portion 10 and the stack wall 6 of FIG. 4 is not present, so only the volume 50 of earth or fill 24 above the platform portion 10 will resist the lateral load 8.

FIG. 6 presents an alternative embodiment for the post portion 12 to maintain more of the lower part of the post portion 12 farther from the stack wall 6 than the configuration illustrated by FIG. 5 or by FIGS. 1 through 4. When the platform portion 10 of the embodiment of FIG. 6 is buried with the bottom flange 28 immediately adjacent to the stack wall 6 and proximal to the surface of the ground 38, only the uppermost part of the post portion 12 is adjacent to the stack wall 6 and only the uppermost part of the post portion 12 will contact the stack wall 6 in the event an excessive lateral load 8 is applied to the fence or handrail post 36. As a result, the post portion 12 will damage only the uppermost part of the stack wall 6 in response to an excessive lateral load 8.

For any of the embodiments, the lateral load 8 that may be accommodated by the post support 2 without rotating the platform portion 10 and without damage to the stack wall 6 may be selected by selecting the volume 50 of earth or fill 24 above the platform portion 10, and hence selecting the weight resisting motion of the platform portion 10. Selecting either the depth of earth or fill 24 over the platform portion 10 or selecting the platform area 18 will select the weight of the earth or fill 24 above the platform portion 10.

The platform portion 10 also has a configuration to prevent earth or fill 24 from moving through the platform portion 10 from the top side 20 to the bottom side 22 when the platform portion 10 is buried under earth or fill 24. The configuration may be that the platform portion 10 presents a solid barrier such as a continuous sheet of metal that prevents passage of the earth or fill 24 through the platform portion 10. As a first alternative to a solid barrier, the platform portion may define openings 56 communicating between the top and bottom sides, but that are too small to allow the passage of earth or fill 24. As a second alternative, and as shown by FIG. 1, the platform portion 10 may define a frame or grid that defines openings 56 large enough for earth or fill 24 to pass through the openings 56. Where the platform portion 10 defines large openings 56, geotextile material 58 may block the openings 56 when the platform portion is buried, as shown by FIG. 3.

Figure 7:
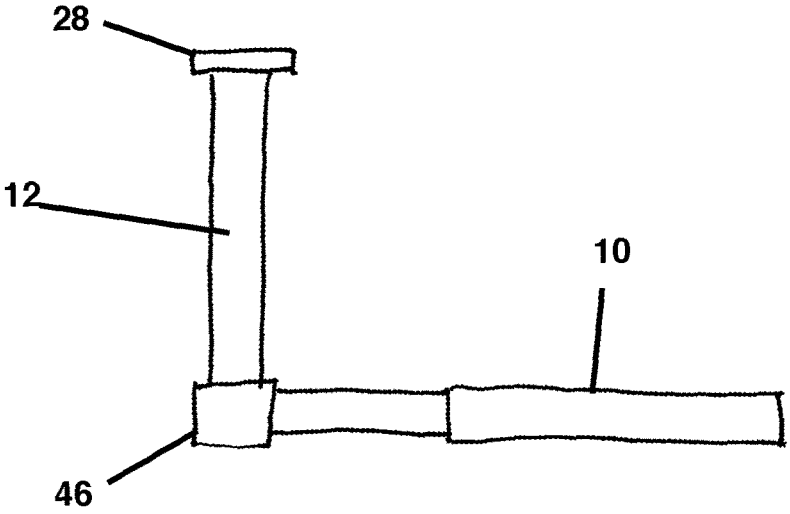
FIG. 7 is a side view of a post support having a separate fulcrum.
Figure 8:
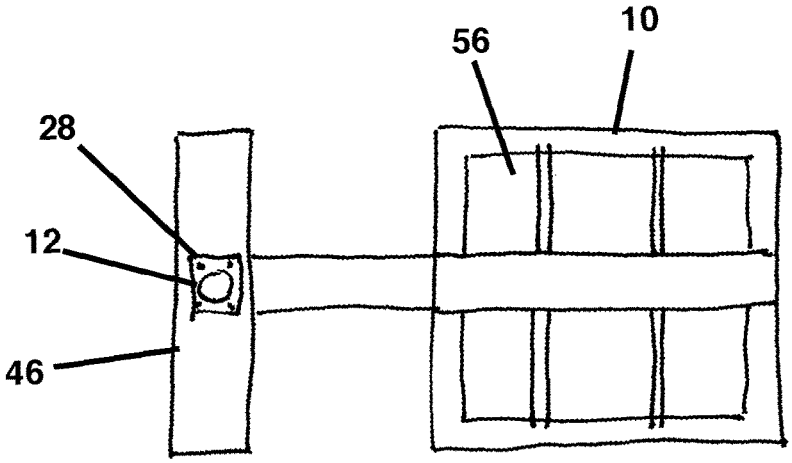
FIG. 8 is a top view of a post support having a separate fulcrum.

FIGS. 7 and 8 are a side view and top view of an embodiment in which the fulcrum 46 is separated from the platform portion 10. In the embodiment of FIGS. 7 and 8, the weight of the earth or fill 24 above the platform portion 10 acts on a longer moment arm than the embodiments illustrated by FIGS. 1 through 6. As a result, a platform area 18 for the embodiment of FIGS. 7 and 8 that is the same as the platform area 18 for the embodiments of FIGS. 1 through 6 will resist a greater lateral load 8 than the embodiments of FIGS. 1 through 6. Conversely, for a given design lateral load 8, the embodiment of FIGS. 7 and 8 may accommodate the design lateral load 8 using a smaller platform area 18 or a smaller vertically spaced-apart relation 32 than the embodiments of FIGS. 1 through 6.

Figure 9:
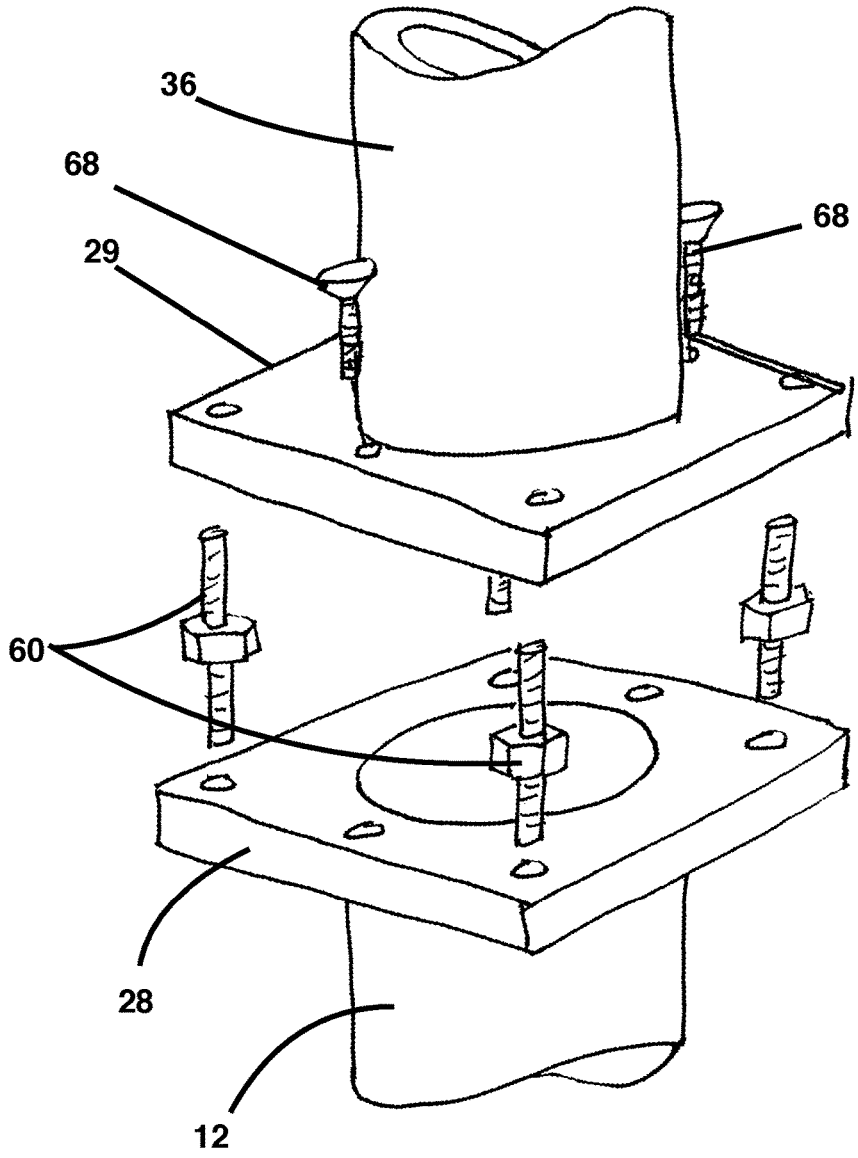
FIG. 9 is a perspective exploded view of the top and bottom flanges.

FIGS. 9 through 12 address alternative embodiments for an adjustable connection between the bottom and top flanges 28, 29. In the embodiment of FIG. 9, four jackscrews 60 connect both the top and bottom flanges 28. One end of each jackscrew 60 has a left hand thread and the other end has a right hand thread. The top and bottom flanges 29, 28 define left and right handed threaded holes that mate with the jackscrews 60. Each jackscrew 60 includes a tool engagement section in the middle of the jackscrew 60, such as a six-sided nut shape for engagement with a wrench. By turning the jackscrews 60, a user may adjust the separation between the top and bottom flanges 29, 28 at the location of each jackscrew 60, thus adjusting both the angle of the fence or handrail post 36 with respect to the platform portion 10 and also adjusting the height of the top flange 29 with respect to the bottom flange 28, and hence with respect to the platform portion 10.

Figure 10:
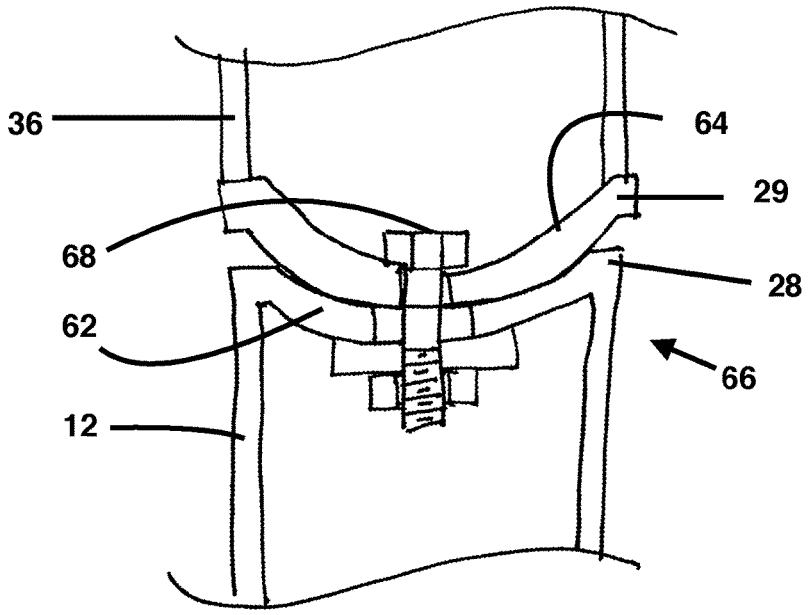
FIG. 10 is a sectional side view of a first alternative top and bottom flange.
Figure 11:
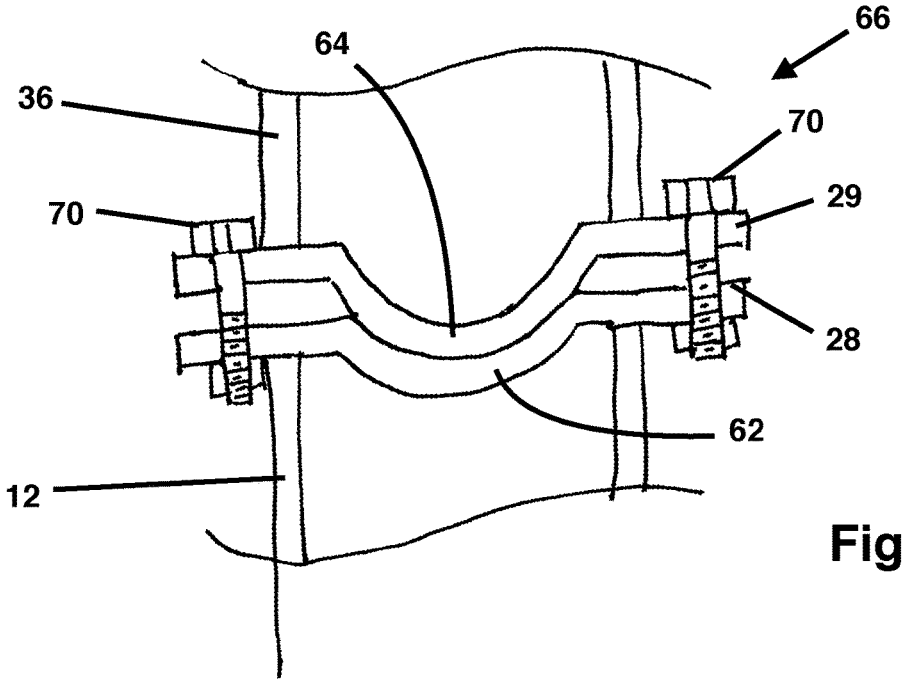
FIG. 11 is a sectional side view of a second alternative top and bottom flange.

FIGS. 10 and 11 are section side views of alternative embodiments in which one of the top and bottom flange 29, 28 defines a socket 62 and the other of the top and bottom flange 29, 28 defines a ball 64. The socket 62 is configured to receive the ball 64. Together the ball 64 and socket 62 define a ball and socket joint 66. Movement of the ball 64 within the socket 62 adjusts the angle of the fence or handrail post 36 with respect to the platform portion 10. A shim interposed between the ball 64 and the socket 62 may adjust the relative height of the top and bottom flanges 29, 28.

In the alternative embodiment of FIG. 10, a fastener in the form of a fixing fastener 68 penetrates the ball and the socket. When the fixing fastener 68 and a corresponding nut are tightened, the nut and bolt 68 clamp the ball and socket 64, 62 together, fixing the fence or handrail post 36 in a selected angle with respect to the platform portion 10.

FIG. 11 shows an alternative embodiment in which fasteners in the form of adjusting bolts 70 penetrate one of the top and bottom flanges 29, 28 and are in threaded engagement with the other of the top and bottom flanges 29, 28. The adjusting bolts both 70 adjust the relative angle of the top and bottom flanges 29, 28 and secure the top and bottom flanges 29, 28 in the selected position.

Figure 12:
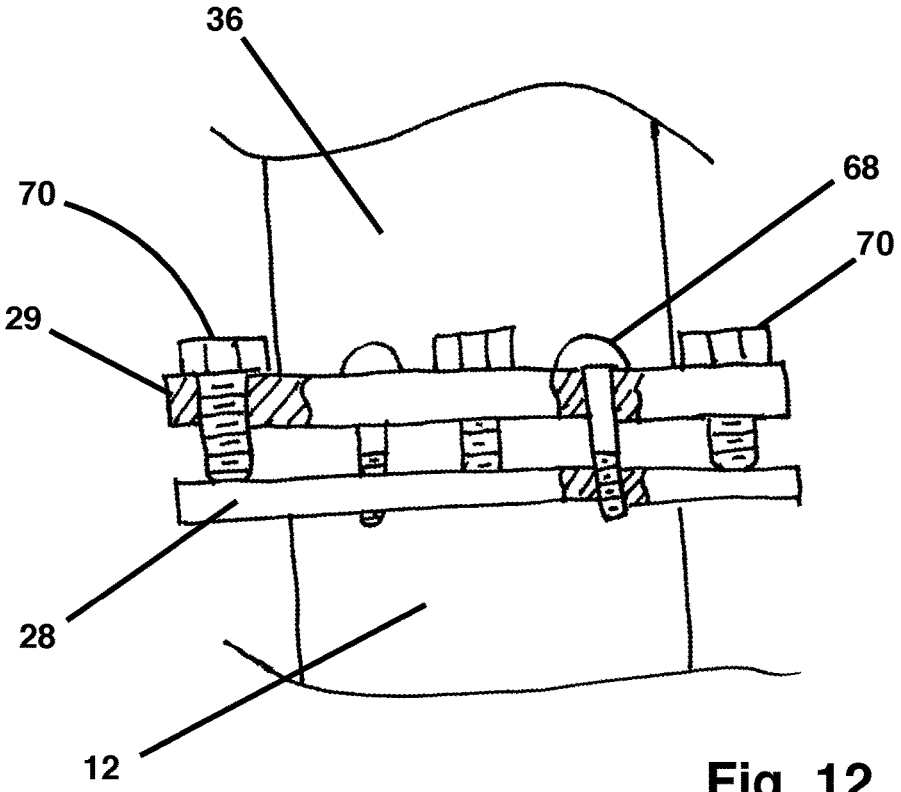
FIG. 12 is a partial cutaway side view of a third alternative top and bottom flange.

FIG. 12 is a detail partial cut away of another embodiment in which adjusting bolts 70 are in threaded engagement with one of the top and bottom flange 29, 28 and bear upon the other of the top and bottom flange 29, 28. The adjusting bolts 70 allow the separation of the top and bottom flanges 29, 28 to be adjusted at the location of each adjusting bolt 70. Separate fixing fasteners 68 secure the top and bottom flanges 29, 28 in the selected position. The embodiment of FIG. 12 allows both the height and angle of the top flange 29 with respect to the bottom flange 28 to be adjusted.

FIG. 12 shows the adjusting bolts 70 in threaded engagement with the top flange 29 and bearing upon the bottom flange 28. The configuration may be reversed with the adjusting bolts 70 in threaded engagement with the bottom flange 28 and bearing upon the top flange 29.

Any other apparatus to adjustably support one object with respect to another is contemplated by the Invention for the adjustable attachment of the top and bottom flanges 28, 26.

The platform portion 10 and the post portion 12 may be composed of any suitable material. Stainless steel has proven suitable in practice. Stainless steel is durable when in contact with earth or fill 24 and does not depend on coatings for that durability. Stainless steel also may be readily formed and welded. Any other suitable material may be used. For example, molded, cast or pultruded polymer resin, whether or not the resin is fiber-reinforced, may form the platform portion 10, post portion 12, bottom and top flanges 28, 29, the fence or handrail post 36 or the fence or handrail 4.

The following is a list of numbered elements identified in the drawings and specification.

A post support 2
Fence or handrail 4
a stack wall 6
a lateral load 8
a platform portion 10
a post portion 12
a length 14
a width 16
a platform area 18
a top side 20
a bottom side 22
earth or fill 24
an end 26
a bottom flange 28
a top flange 29
a laterally spaced-apart relation 30
a vertically spaced-apart relation 32
an attachment location 34
a post base 35
a fence post or handrail post 36
ground 38
a higher elevation side 40
a lower elevation side 42
a predetermined depth 44
a fulcrum 46
a pull of gravity 48
volume 50 of earth or fill above the platform portion
volume 52 of earth or fill between the platform portion and the stack wall
curve 54
openings 56
geotextile material 58
a jack screw 60
a socket 62
a ball 64
a ball and socket joint 66
fixing fastener 68
adjusting bolts 70

I claim:

1. A post support for supporting a fence post or handrail post, the fence or handrail post having a post base, the post support comprising:

a. a platform portion, said platform portion having a length and a width, said length and said width defining a platform area, said platform portion being configured for burial under a predetermined depth of an earth or fill and with said platform area is oriented generally normal to a pull of gravity;

b. a post portion, said post portion being attached to said platform portion, said post portion having a configuration to selectably attach said post portion to the post base of the fence or handrail post so that the post base is in a laterally spaced-apart relation to said platform area and so that the post base is in a vertically spaced-apart relation to said platform portion, wherein said predetermined depth of said earth or fill is defined by said vertically spaced-apart relation of the post base and said platform area;

c. a bottom flange, said bottom flange defining an end of said post portion distal to said platform portion, said bottom flange being configured for an adjustable attachment to said post base, said bottom flange being located proximal to a surface of a ground when said platform portion is buried under said predetermined depth of earth or fill, and d. a top flange defined by the post base, said bottom flange being configured for an adjustable attachment to said top flange, said adjustable attachment of said bottom flange to said top flange being configured to allow adjustment of an angle of said fence or handrail post with respect to said platform portion, whereby when said platform portion is buried under said predetermined depth of said earth or fill and said post portion is attached to the post base, a weight of said earth or fill on top of said platform portion will resist a motion of said fence post or handrail post in response to a lateral load applied to said fence or handrail.

2. The post support of claim 1 wherein said adjustable attachment of said bottom flange to said top flange is configured to allow adjustment of a height of said fence or handrail post with respect to said platform portion.

3. The post support of claim 2 wherein said adjustable attachment comprises: a plurality of jack screws, each of said plurality of jack screws being configured to be attached to both said bottom flange and said top flange and to locally adjust a separation between said bottom flange and said top flange.

4. The post support of claim 1 wherein a one of said top flange and said bottom flange defines a one of a ball and another of said top flange and said bottom flange defines a socket configured to receive said ball, said ball and said socket in combination defining a ball and socket joint, said ball and socket joint being configured to allow an adjustment of said angle between said fence post or said handrail post and said platform portion, the apparatus further comprising: at least one fixing fastener, said at least one fixing fastener being configured to fix said ball and said socket with respect to one another.

5. The post support of claim 4 wherein said platform portion defines a top side and a bottom side, said platform portion is configured to resist a motion of said earth or fill through said platform area from said top side to said bottom side when said platform portion is buried in said earth or fill.

6. A retaining wall, the retaining wall comprising:

a. a stack wall, said stack wall having a higher elevation side;

b. a platform portion, said platform portion defining a length and a width, said length and width of said platform portion defining a platform area, said platform portion being buried under a predetermined depth of earth or fill on said higher-elevation side with said platform area oriented generally normal to a pull of gravity, said platform area being in a laterally spaced-apart relation to said stack wall;

c. a post portion, said post portion being attached to said platform portion, said platform portion supporting said post portion;

d. a post base, said post base being attached to said post portion, said post portion supporting said post base, said post base being located adjacent to said stack wall and between said platform area and said stack wall, said post base being in a vertically spaced-apart relation to said platform area, said post base being in a laterally spaced-apart relation to said platform area;

e. a fence or handrail post attached to said post base, said post base supporting said fence or handrail post, whereby said post base is located closer to said stack wall than said platform area and whereby a weight of said predetermined depth of earth or fill over said platform area will resist a motion of said post portion, said post base and said fence or handrail post in response to a lateral load applied to said fence or handrail post, wherein said post portion comprises: a bottom flange, said bottom flange defining an end of said post portion distal to said platform portion, said bottom flange being located proximal to a surface of a ground, said bottom flange being configured to selectably attach said post portion to said post base, wherein said post base is defined by a top flange, said bottom flange having an adjustable attachment to said top flange, said adjustable attachment being configured to allow adjustment of an angle of said fence or handrail post with respect to said platform portion.

7. The retaining wall of claim 6 wherein said adjustable attachment of said bottom flange to said top flange is configured to allow adjustment of a height of said fence post or said handrail post with respect to said platform portion.

8. The retaining wall of claim 7 wherein said adjustable attachment comprises: a plurality of jack screws, each of said plurality of jack screws being configured to be attached to both said bottom flange and said top flange and to locally adjust a separation between said bottom flange and said top flange.

9. The retaining wall of claim 6 wherein a one of said top flange and said bottom flange defines a one of a ball and another of said top flange and said bottom flange defines a socket configured to receive said ball, said ball and said socket in combination defining a ball and socket joint, said ball and socket joint being configured to allow an adjustment of said angle between said fence or handrail post and said platform portion, the retaining wall further comprising: at least one fastener, said at least one fastener being configured to fix said ball and said socket with respect to one another.

10. The retaining wall of claim 6 wherein said platform portion defines a top side and a bottom side, said platform portion having a configuration to resist a motion of said earth or fill through said platform portion from said top side to said bottom side when said platform portion is buried in said earth or fill.

11. The retaining wall of claim 10 wherein said platform area defines openings, said openings being large enough to allow earth or fill to pass through said openings, said configuration to resist said motion of said earth or fill through said platform portion comprises: a geotextile fabric interposed between said platform portion top side and said predetermined depth of earth or fill.

12. A method of constructing a retaining wall, the method comprising:

a. constructing a stack wall, said stack wall having a higher-elevation side;

b. providing a post support, said post support having a platform portion and a post portion, said platform portion having a length and a width, said length and said width together defining a platform area, said post portion being attached to said platform portion, an end of said post portion distal to said platform portion defining a bottom flange, said bottom flange being in a laterally spaced apart relation to said platform portion, said bottom flange being in a vertically spaced apart relation to said platform portion;

c. burying said platform portion under a predetermined depth of earth or fill on said higher-elevation side of said stack wall, said platform area being oriented generally normal to a pull of gravity, said bottom flange being disposed between said platform area and said stack wall, said bottom flange being located generally at a surface of a ground immediately adjacent to said higher elevation side of said stack wall;

d. attaching a post base of a fence or handrail post to said bottom flange, wherein said vertically spaced-apart relation defining said predetermined depth of earth or fill, said post base defining a top flange, said bottom flange being configured for adjustable attachment to said top flange, said adjustable attachment of said bottom flange to said top flange being configured to allow adjustment of an angle of said fence or handrail post with respect to said platform portion; and e. selecting said angle between said fence or handrail post and said platform portion.

13. The method of claim 12 wherein said step of attaching said post base to said bottom flange further comprises:

a. selecting a height of said fence or handrail post with respect to said platform portion; and b. attaching said post base to said bottom flange at said selected height.

* * * * *